US006853823B2

(12) United States Patent
Sugino et al.

(10) Patent No.: US 6,853,823 B2
(45) Date of Patent: Feb. 8, 2005

(54) ELECTROPHOTOGRAPHIC PHOTORECEPTOR AND IMAGE FORMING APPARATUS USING THE PHOTORECEPTOR

(75) Inventors: Akihiro Sugino, Numazu (JP); Ryohichi Kitajima, Numazu (JP); Yoshiaki Kawasaki, Susono (JP); Takaaki Ikegami, Susono (JP); Eiji Kurimoto, Numazu (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 10/384,662

(22) Filed: Mar. 11, 2003

(65) Prior Publication Data

US 2003/0215726 A1 Nov. 20, 2003

(30) Foreign Application Priority Data

Mar. 11, 2002 (JP) ..... 2002-065052

(51) Int. Cl.[7] ..... G03G 15/01; G03G 5/047

(52) U.S. Cl. ..... 399/159; 399/297; 430/58.05; 430/970

(58) Field of Search ..... 430/58.05, 970, 430/58.85; 399/159, 279, 299

(56) References Cited

U.S. PATENT DOCUMENTS 4,942,104 A 7/1990 Kitajima et al.
5,339,138 A 8/1994 Mishima et al.
5,411,827 A 5/1995 Tamura et al.
5,496,671 A 3/1996 Tamura et al.
5,578,405 A 11/1996 Ikegami et al.
5,677,094 A * 10/1997 Umeda et al. ..... 430/58.05
5,702,855 A 12/1997 Ikegami et al.
6,030,736 A 2/2000 Ikegami et al.
6,319,878 B1 11/2001 Ina et al.
6,432,596 B2 8/2002 Ikuno et al.
6,492,079 B2 * 12/2002 Shimada et al. ..... 430/58.05
6,521,387 B2 2/2003 Kawasaki
6,548,216 B2 * 4/2003 Kawamura et al. ..... 430/59.6

* cited by examiner

*Primary Examiner*—John L. Goodrow
(74) *Attorney, Agent, or Firm*—Oblon, Spivak, McClelland, Maier & Neustadt, P.C.

(57) ABSTRACT

An electrophotographic photoreceptor includes an electroconductive substrate. A charge generation layer overlies the electroconductive substrate. A first charge transport layer overlying the charge generation layer includes a first charge transport material (D1) and a first binder resin (R1). A second charge transport layer overlying the first charge transport layer includes a filler, a second charge transport material (D2) and a second binder resin (R2). The first and second charge transport layers have a total thickness of from 5 to 25 μm. A weight ratio (D1/R1) of the first charge transport material (D1) to the first binder resin (R1) in the first charge transport layer is greater than a weight ratio (D2/R2) of the second charge transport material (D2) to the second binder resin (R2) in the second charge transport layer.

10 Claims, 6 Drawing Sheets

ELECTROPHOTOGRAPHIC PHOTORECEPTOR AND IMAGE FORMING APPARATUS USING THE PHOTORECEPTOR

CROSS-REFERENCE TO RELATED APPLICATION

This application claims benefit of priority to Japanese application no. 2002-065052, filed March 11, 2002, the disclosure of which is incorporated by reference herein in its entirety.

BACKGROUND OF THE INVENTION

1. Field of the Invention

The present invention relates to an electrophotographic photoreceptor, as well as an image forming apparatus and a process cartridge using the photoreceptor, which realize high-speed printing, high-quality image production and high durability simultaneously.

2. Discussion of the Background

Recently, data processing systems using electrophotographic methods have made remarkable progress. In particular, laser printers and digital copiers which record data with light by changing the data into digital signals have made remarkable improvements in their printing qualities and reliabilities. Further, technologies used in these printers and copiers have been applied with high-speed printing technologies to laser printers and digital copiers capable of printing full-color images.

Recently, in accordance with high-speed printing of an electrophotographic apparatus, high sensitivity and response of an electrophotographic photoreceptor have been required, and further in accordance with downsizing of the apparatus, a smaller diameter or size and higher durability of the photoreceptor are required. To meet such requirements, Japanese Patent Publication No. 2838891 discloses a photoreceptor having both higher durability and sensitivity, wherein a specific charge generation layer (hereinafter referred to as a CGL) thereof has an electric field dependence of sufficiently a small quantum efficiency such that a gradient b is not greater than 0.5 in the following formula:

$$\eta = a \times E^b \quad \text{(I)}$$

wherein $\eta$ is a quantum efficiency of the photoreceptor, a is a constant, and E is an electric intensity, and wherein a charge transport layer (hereinafter referred to as a CTL) thereof has a thickness of from 25 to 60 $\mu$m.

Typically, a low-molecular-weight charge transport material used in a CTL is dispersed and mixed with an inactive polymer because the charge transport material is not capable of forming a film alone. A CTL formed of such low-molecular-weight charge transport materials and inactive polymers typically has a low hardness. Therefore, a coated film of the CTL is largely abraded due to repeated use in the Carlson process, resulting in deterioration of charge potential and photosensitivity of the resultant photoreceptor, background fouling due to a damage of a surface thereof and deterioration of the resultant image density and quality. Accordingly, it is preferable to increase thickness of the CTL to provide higher durability against the abrasion due to the repeated use.

In addition, typically in a multilayer electrophotographic photoreceptor, since a surface potential and a surface charge thereof are on a straight line passing through an original point, a superficial capacitance of the photoreceptor C=Q/V (C: a capacitance, Q: charge and V: surface potential) and $C=\epsilon\epsilon_0/d$ ($\epsilon$: specific inductive capacity, $\epsilon_0$: vacuum inductive capacity and d: thickness of the photosensitive layer) can be obtained using a planographic condenser model. From these formulae, for a given surface potential it is found that a photoreceptor having a thin film has a large surface charge and a photoreceptor having a thick film has a small surface charge. When light having the same energy is irradiated to each of the photoreceptors and the same charge amount is generated, the surface charge of the thin film is not sufficiently extinguished and the irradiated part potential slightly decreases and the surface charge of the thick film is sufficiently extinguished and the irradiated part potential largely decreases. Namely, the thin film has less sensitivity than the thick film. Therefore, it can be said that the above-mentioned electrophotographic photoreceptor having a thick CTL has a higher sensitivity.

In the recent electrophotographic process, a so-called digital electrophotographic method writing an electrostatic latent image on a photoreceptor using a LD or LED is prevalent for high quality images, high-speed printing and expansible digital networks. As mentioned above, popularization of printers, copiers and full-color printers using such methods further requires higher image quality, higher speed printing and higher durability.

However, the above-mentioned electrophotographic photoreceptor having a thick photosensitive layer is disadvantageous for higher image quality because a charge injected in the CTL does not smoothly reach a surface of the photoreceptor to neutralize the surface charge, which causes blurred images. Further, the thicker the CTL, the influence significantly causes deterioration of the resultant image quality.

As a method of forming a photoreceptor having both high durability and image quality, it is attempted to form a protection layer to improve surface abrasion resistance of the photoreceptor and a thin CTL. However, the thin CTL causes deterioration of sensitivity as mentioned above.

In order to solve this problem, it can be considered that a charge potential is decreased. Namely, in the formula C=Q/V, even when the superficial capacitance becomes larger due to a thinner film, the lower surface potential V does not make the surface charge Q larger and prevents the deterioration of sensitivity. However, when the surface potential is decreased, a surface potential difference between an irradiated part and a non-irradiated part becomes small and it becomes difficult to form a sharp electrostatic latent image. Further, when a photoreceptor is electrostatically fatigued due to repeated use, chargeability of the photoreceptor deteriorates and residual potential thereof increases. Therefore, the surface potential difference between an irradiated part and a non-irradiated part becomes smaller, resulting in abnormal images such as background fouling and deterioration of image density.

As mentioned above, it has been quite difficult for a conventional image forming apparatus to realize high-speed printing, high-quality image production and high durability simultaneously.

Therefore, a need exists for an image forming apparatus realizing high-speed printing, high-quality image production and high durability simultaneously.

SUMMARY OF THE INVENTION

Accordingly, an object of the present invention is to provide an image forming apparatus, a tandem-type full color image forming apparatus and a process cartridge, which realize high-speed printing, high-quality image production and high durability simultaneously.

Briefly this object and other objects of the present invention can be attained by an electrophotographic photoreceptor including at least an electroconductive substrate; a CGL overlying the electroconductive substrate; a first CTL overlying the CGL and comprising a first charge transport material (D1) and a first binder resin (R1); and a second CTL overlying the first CTL and comprising a filler, a second charge transport material (D2) and a second binder resin (R2), wherein the first and second CTLs have a total thickness of from about 5 to about 25 $\mu$m, and wherein a weight ratio (D1/R1) of the first charge transport material (D1) to the first binder resin (R1) in the first CTL is greater than a weight ratio (D2/R2) of the second charge transport material (D2) to the second binder resin (R2) in the second CTL.

In addition, a thickness of the first CTL is preferably not less than a thickness of the second CTL.

Further, the filler in the second CTL is preferably an inorganic material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image forming apparatus, a tandem-type full color image forming apparatus, and a process cartridge, which realize high-speed printing, high-quality image production and high durability simultaneously.

Hereinafter, examples of the present invention will be explained in detail.

Figure 1:
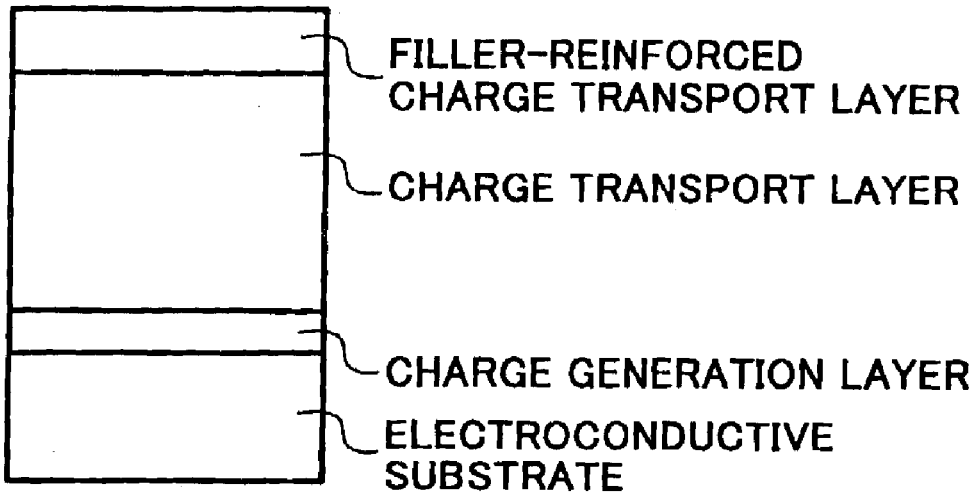
FIG. 1 is a schematic view illustrating a cross section of an embodiment of a layer composition of an electrophotographic photoreceptor according to the present invention.

FIG. 1 is a schematic view illustrating a cross section of an embodiment of a layer composition of an electrophotographic photoreceptor according to the present invention. The photoreceptor of FIG. 1 has a functionally-separated photosensitive layer including a CGL, a CTL and a filler-reinforced CTL on an electroconductive substrate.

Figure 2:
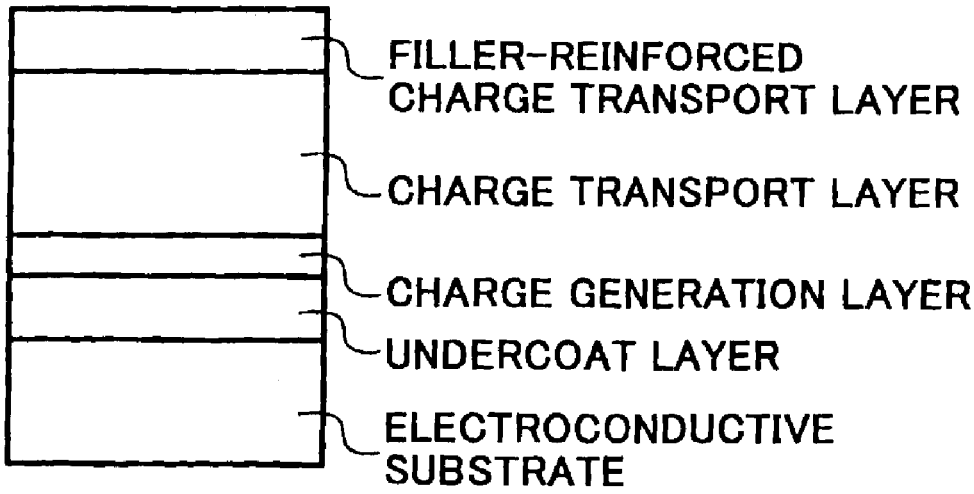
FIG. 2 is a schematic view illustrating a cross section of another embodiment of a layer composition of an electrophotographic photoreceptor according to the present invention.

FIG. 2 is a schematic view illustrating a cross section of another embodiment of a layer composition of an electrophotographic photoreceptor according to the present invention. The photoreceptor of FIG. 2 has an undercoat layer between an electroconductive substrate and a photosensitive layer including a CGL, a CTL and a filler-reinforced CTL.

<Electroconductive Substrate>

Suitable materials for use as the electroconductive substrate include materials having a volume resistance not greater than about $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid. In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the substrate.

<CGL>

The CGL can include a charge generation material, and optionally can include a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys, selenium-arsenic alloys and amorphous silicon. Suitable amorphous silicon includes ones in which a dangling bond is terminated with a hydrogen atom or a halogen atom, or in which a boron atom or a phosphorus atom is doped.

Specific examples of the organic charge generation materials include known materials, for example, phthalocyanine pigments such as metal phthalocyanine and metal-free phthalocyanine, azulenium pigments, squaric acid methane pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. Further, a low-molecular-weight charge transport material may be optionally included in the CGL.

Positive hole transport materials and electron transport materials are used as the charge transport material which can be optionally included in the CGL.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transport materials can be used alone or in combination.

Specific examples of the positive hole transport materials include electron donating materials such as oxazole derivatives, oxadiazole derivatives, imidazole derivatives, triphenyl amine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like materials. These positive hole transport materials can be used alone or in combination.

The CGL includes a charge generation material, a solvent and a binder resin as components, and may include any additives such as a sensitizer, a disperser, a detergent and a silicone oil.

Suitable methods for forming the CGL include thin film forming methods in a vacuum and casting methods using a solution or a dispersion. Specific examples of the former methods include vacuum evaporation methods, glow discharge decomposition methods, ion plating methods, sputtering methods, reaction sputtering methods, CVD methods, and the like methods. A layer of the above-mentioned inorganic and organic materials can be preferably formed by these methods. The casting methods for forming the CGL include preparing a coating liquid by mixing an inorganic or organic charge generation material mentioned above with a solvent such as tetrahydrofuran, cyclohexanone, dioxane, dichloroethane, butanone, with or without a binder resin; and an additive, and dispersing the mixture with a ball mill, an attritor, and/or a sand mill; and coating on a substrate the coating liquid, which is diluted if necessary, by a dip coating method, a spray coating method, and/or a bead coating method.

The CGL formed as above preferably has a thickness of from about 0.01 to about 5 μm, and more preferably from about 0.05 about to 2 μm.

<CTL>

The CTL can be formed by dissolving or dispersing a mixture or a copolymer including a charge transport material and a binder resin as main components in a proper solvent, and coating and drying the resultant mixture. The CTL is preferably a thin film for high resolution and quality images, and has to have a total thickness of from about 5 to about 25 μm with an after-mentioned filler-reinforced CTL. When less than about 5 μm, chargeability of the resultant photoreceptor deteriorates to cause background fouling, and a discharge breakdown is likely to happen. When greater than about 25 μm, a charge injected in the CTL does not smoothly reach a surface of the photoreceptor to neutralize the surface charge, resulting in blurred images, deterioration of fine dot reproducibility and fattening of thin lines.

Specific examples of polymer compounds which can be used as the binder resin in the present invention include thermoplastic resins and thermosetting resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinylcarbazole, acrylic resins, silicone resins, epoxy resins, melamine resins, urethane resins, phenolic resins, alkyd resins and the like resins. However, the polymer compounds are not limited thereto. These polymer compounds can be used alone or in combination, and the polymer compounds copolymerized with a CTL can also be used.

Specific examples of the charge transport materials include the above-mentioned low-molecular-weight electron transport materials and positive hole transport materials. A content of the charge transport materials is preferably from about 20 to about 200 parts by weight, and more preferably from about 50 to about 100 parts by weight per 100 parts by weight of the polymer compounds. Specific examples of dispersion solvents for use in preparing a CTL coating liquid include ketones such as methyl ethyl ketone, acetone, methyl isobutyl ketone and cyclohexanone; ethers such as dioxane, tetrahydrofuran and ethyl cellosolve; aromatic series such as toluene and xylene; halogens such as chlorobenzene and dichloromethane; and esters such as ethyl acetate and butyl acetate.

<Filler-Reinforced CTL>

Next, the filler-reinforced CTL will be explained. The filler-reinforced CTL in the present invention can include a charge transport material, a binder resin and a filler for the purpose of improving abrasion resistance of the resultant photoreceptor, such that the filler-reinforced CTL has charge transportability and mechanical durability. The filler-reinforced CTL has high charge transportability which is equivalent to that of a conventional CTL, and is used as a surface layer in a multilayer photoreceptor. Namely, the filler-reinforced CTL overlies a CTL which does not include a filler.

Filler materials for use in the filler-reinforced CTL include organic and inorganic fillers. Specific examples of organic filler materials include a fluorocarbon resin powder such as polytetrafluoroethylene, a silicone resin powder and α-carbon powder. Specific examples of inorganic filler materials include metallic powders such as copper, tin, aluminium and indium; metal oxides such as silica, tin oxide, zinc oxide, titanium oxide, alumina, zirconium oxide, indium oxide, stibium oxide, bismuth oxide, calcium oxide, zinc oxide doped with stibium and indium oxide doped with zinc; metal fluorides such as zinc fluoride, calcium fluoride and aluminium fluoride; and inorganic materials such as kalium titanate and boron nitride. Among these fillers, inorganic materials are advantageously used in terms of hardness of the filler to improve abrasion resistance of the resultant photoreceptor. Particularly, the silica, titanium oxide and alumina are effectively used. These fillers can be used alone or in combination. A surface treatment agent may be applied to a surface of the filler for the purpose of improving dispersibility thereof in a coating liquid and a coated film.

These fillers can be dispersed with a charge transport material, a binder resin and a solvent by a proper disperser. Further, the filler preferably has an average primary particle diameter of from about 0.01 to about 0.8 μm in terms of transmittance and abrasion resistance of the CTL.

As a coating method, a dip coating method, spray coating method, a ring coating method, a roll coating method, a gravure coating method, a nozzle coating method, and/or a screen printing method can be used.

Conventionally, it is known that when surface abrasion of a photoreceptor is prevented a low-resistance material generated by a discharge, which is adhered to the surface thereof, cannot be removed and abnormal images such as blurred images are produced. Therefore, the filler-reinforced CTL preferably has an abrasion resistance such that it can be slightly abraded. In consideration of the abrasion, the filler-reinforced CTL preferably has a thickness of from about 0.5 to about 10 μm, and more preferably from about 2 to about 5 μm. In addition, since the filler-reinforced CTL has a lower weight ratio (D/R) of the charge transport material (D) and the binder resin (R) than that of the above-mentioned CTL, the filler-reinforced CTL has less charge transportability than that of the CTL. Therefore, when a thickness (d1) of the filler-reinforced CTL is larger than a thickness (d2) of the CTL, the resultant photoreceptor can have insufficient sensitivity. Accordingly, d1 and d2 preferably have the following relationship:

$$d1 \geqq d2$$

<Undercoat Layer>

An undercoat layer may be formed between the electroconductive substrate and the photosensitive layer.

The undercoat layer is formed for the purpose of improving adherence of the photosensitive layer to the electroconductive substrate, preventing moiré, improving coating capability of the above layer and decreasing a residual potential. The undercoat layer includes a resin. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor. The undercoat layer can be formed by using a proper solvent and a coating method.

Further, the undercoat layer of the present invention may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. The undercoat layer preferably has a thickness of from about 0.1 to about 20 μm, and more preferably from about 1 to about 10 μm.

In the present invention, one or more additives such as antioxidants, plasticizers, lubricants, ultraviolet absorbents, low-molecular-weight charge transport materials and leveling agents can be included in each of the layers (i.e., the CGL, CTL, filler-reinforced CTL and undercoat layer) to improve the stability to withstand environmental conditions, such as to avoid decrease of photosensitivity and increase of residual potential. Such compounds will be shown as follows. Suitable antioxidants for use in each of the layers include the following compounds, but are not limited thereto:

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds

Dilauryl-3,3'-thiodipropionate, distearyl-3,3'-thiodipropionate, ditetradecyl-3,3'-thiodipropionate, and the like.

(e) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine and the like.

Suitable plasticizers for use in each of the layers include the following compounds, but are not limited thereto:

(a) Phosphoric Acid Esters Plasticizers

Triphenyl phosphate, tricresyl phosphate, trioctyl phosphate, octyldiphenyl phosphate, trichloroethylphosphate, cresyldiphenyl phosphate, tributyl phosphate, tri-2-ethylhexyl phosphate, triphenyl phosphate, and the like.

(b) Phthalic Acid Esters Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters Plasticizers

Trioctyl trimellitate, tri-n-octyl trimellitate, octyl oxybenzoate, and the like.

(d) Dibasic Fatty Acid Esters Plasticizers

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetylricinolate, pentaerythritol esters, dipentaerythritol hexaesters, triacetin, tributyrin, and the like.

(f) Oxyacid Esters Plasticizers

Methyl acetylricinolate, butyl acetylricinolate, butylphthalylbutyl glycolate, tributyl acetylcitrate, and the like.

(g) Epoxy Plasticizers

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters Plasticizers

Diethylene glycol dibenzoate, triethylene glycol di-2-ethylbutylate, and the like.

(i) Chlorine-Containing Plasticizers

Chlorinated paraffin, chlorinated diphenyl, methyl esters of chlorinated fatty acids, methyl esters of methoxychlorinated fatty acids, and the like.

(j) Polyester Plasticizers

Polypropylene adipate, polypropylene sebacate, acetylated polyesters, and the like.

(k) Sulfonic Acid Derivatives

P-toluene sulfonamide, o-toluene sulfonamide, p-toluene 5 sulfoneethylamide, o-toluene sulfoneethylamide, toluene sulfone-N-ethylamide, p-toluene sulfone-N-cyclohexylamide, and the like.

(l) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds

Terphenyl, partially hydrated terphenyl, camphor, 2-nitro diphenyl, dinonyl naphthalene, methyl abietate, and the like.

Suitable lubricants for use in each of the layers include the following compounds, but are not limited thereto.

(a) Hydrocarbon Compounds

Liquid paraffins, paraffin waxes, micro waxes, low molecular weight polyethylenes, and the like.

(b) Fatty Acid Compounds

Lauric acid, myristic acid, palmitic acid, stearic acid, arachidic acid, behenic acid, and the like.

(c) Fatty Acid Amide Compounds

Stearic acid amide, palmitic acid amide, oleic acid amide, methylenebisstearamide, ethyl enebisstearamide, and the like.

(d) Ester Compounds

Lower alcohol esters of fatty acids, polyhydric alcohol esters of fatty acids, polyglycol esters of fatty acids, and the like.

(e) Alcohol Compounds

Cetyl alcohol, stearyl alcohol, ethylene glycol, polyethylene glycol, polyglycerol, and the like.

(f) Metallic Soaps

Lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds

Silicone compounds, fluorine compounds, and the like.

Suitable ultraviolet absorbing agents for use in the layers include the following compounds, but are not limited thereto:

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds

Phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole and (2'-hydroxy-3'-t-butyl-5'-methylphenyl)-5-chlorobenzotriazole.

(d) Cyano Acrylate Compounds

Ethyl-2-cyano-3,3-diphenyl acrylate, methyl-2-carbomethoxy-3-(paramethoxy) acrylate, and the like.

(e) Quenchers (Metal Complexes)

Nickel (2,2'-thiobis(4-t-octyl)phenolate)-n-butylamine, nickeldibutyldithiocarbamate, cobaltdicyclohexyldithiophosphate, and the like.

(f) HALS (Hindered Amines)

Bis (2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy)ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-15 1,3,8-triazaspiro[4,5]undecane-2,4-dione, 4-benzoyloxy-2,2,6,6-tetramethylpiperidine, and the like.

Figure 3:
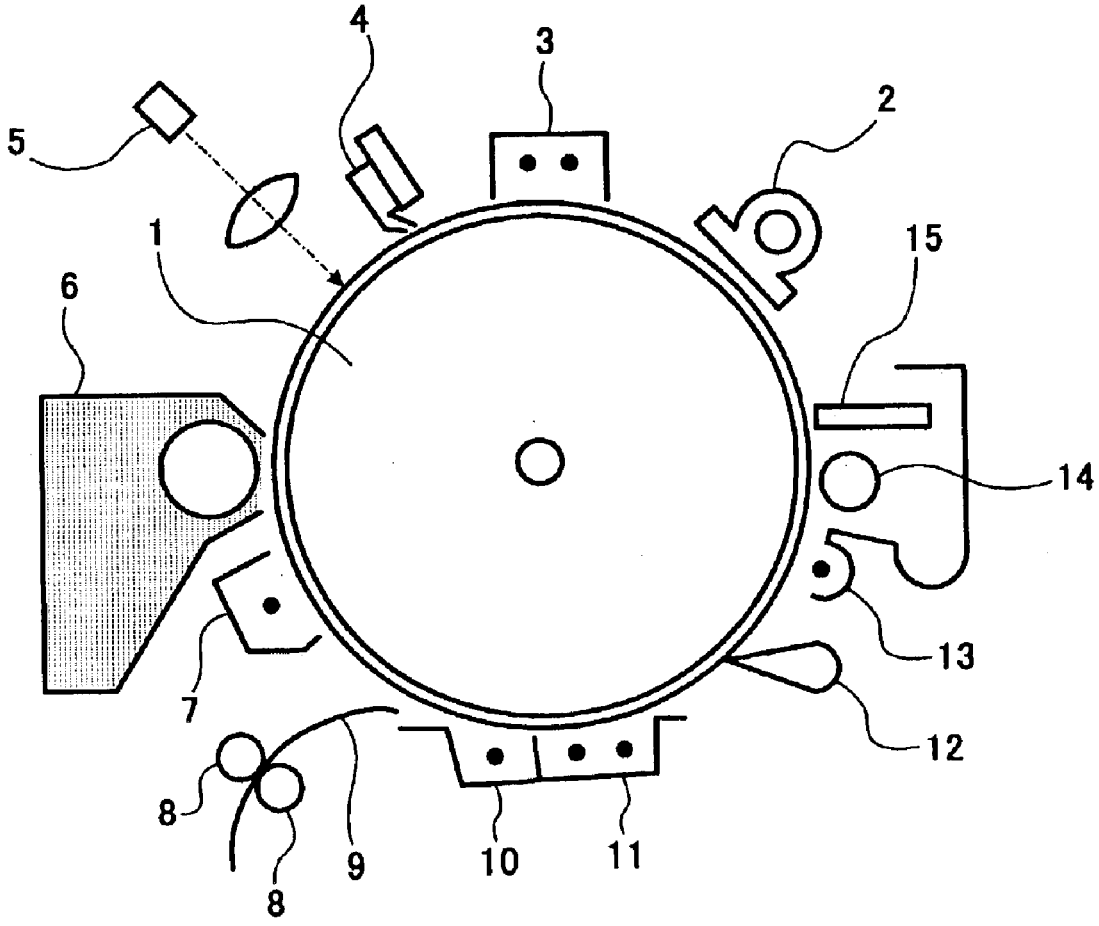
FIG. 3 is a schematic view illustrating a cross section of an embodiment of an image forming apparatus according to the present invention.

FIG. 3 is a schematic view illustrating a cross section of an embodiment of an image forming apparatus according to the present invention.

In FIG. 3, a photoreceptor 1 is produced in accordance with the present invention. Although the photoreceptor 1 has the shape of a drum, the photoreceptor can have the shape of a sheet or an endless belt. Known methods including corona chargers (such as corotron and scorotron) and charging rollers are used for a charger 3, a pre-transfer charger 7, a transfer charger 10, a separation charger 11 and a pre-cleaning charger 13. Since the photoreceptor of the present invention has a thin photosensitive layer, a non-irradiated part thereof preferably has a potential of from about −300 to about −800 V, and more preferably from about −350 to about 700 V to prevent deterioration of sensitivity of the photoreceptor. When the non-irradiated part has a potential less than about −300 V, a potential difference between an irradiated part and the non-irradiated part of the photoreceptor may be too small to obtain a sharp electrostatic latent image, resulting in production of poor quality images. In addition, deterioration of the photoreceptor due to repeated use and significant deterioration of the resultant images because of the insufficiently charged photoreceptor and an increase of the residual potential thereof due to a temperature and humidity in the environment can occur. When the non-irradiated part has a potential greater than about −800 V, the photoreceptor having a thin photosensitive layer may have less sensitivity, and background fouling and discharge breakdown can occur, resulting in production of poor quality images.

As a transferer, the above-mentioned chargers can be used. Among the chargers, a combination of the transfer charger and the separating charger, as shown in FIG. 3, is preferably used.

A combination of the electrophotographic photoreceptor having a total thickness of from about 5 to about 25 $\mu$m of its CTL and filler-reinforced CTL of the present invention and a digital image forming process using a LD having a small beam diameter or a smaller pulse interval can form a high-resolution electrostatic latent image on the photoreceptor, and therefore high quality images are produced. In particular, the combination is considerably effective for a process writing at a resolution not less than about 1,200 dpi on a photoreceptor.

As a light source for a discharge lamp 2, general light emitting materials such as fluorescent lamps, tungsten lamps, halogen lamps, mercury lamps, sodium lamps, LEDs, LDs and electroluminescence (EL) can be used. In addition, in order to obtain light having a desired wave length range, filters such as sharp-cut filters, band pass filters, near-infrared cutting filters, dichroic filters, interference filters, color temperature converting filters and the like can be used.

The light sources can be used for not only the processes mentioned above and illustrated in FIG. 3, but also other processes, such as a transfer process, a discharging process, a cleaning process, and a pre-exposure process, which include light irradiation to the photoreceptor.

When a toner image formed on the photoreceptor 1 by an image developer 6 is transferred onto a transfer sheet 9, all of the toner image is not transferred on the transfer sheet, and residual toner particles remain on the surface of the photoreceptor 1. The residual toner is removed from the photoreceptor by a brush 14 and/or a cleaning blade 15. Suitable cleaning brushes include known cleaning brushes such as fur brushes and mag-fur brushes.

Figure 4:
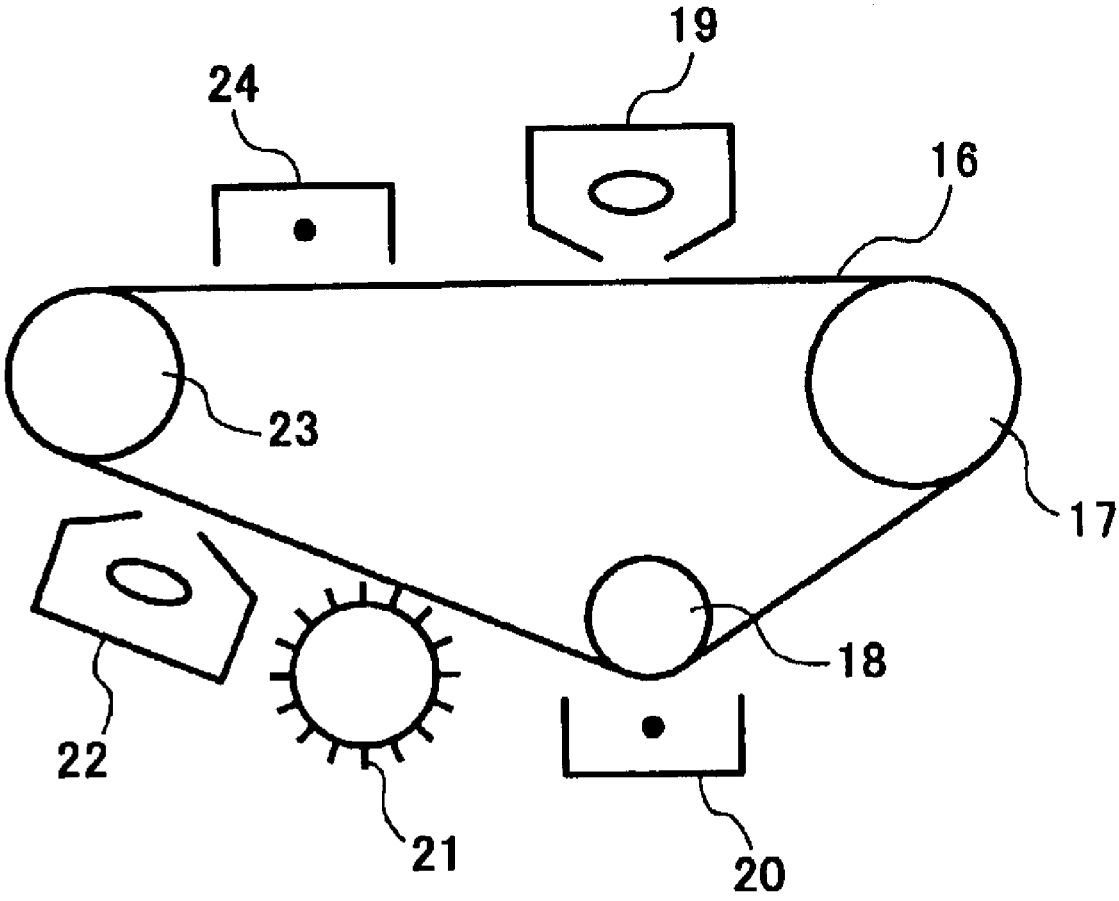
FIG. 4 is a schematic view illustrating another embodiment of an image forming apparatus according to the present invention.

FIG. 4 is a schematic view illustrating another embodiment of the image forming apparatus according to the present invention. A photoreceptor 16 is an electrophotographic photoreceptor having the shape of a flexible endless belt and produced in accordance with the present invention. The photoreceptor 16 is driven by a driving roller 17 and smoothly rotated by a tension roller 18 and a driven roller 23 without a surface waviness and slippage. The charging of a photoreceptor 16 with a charger 24, irradiating the photoreceptor with a light source 19, developing an image (not shown), transferring the image with a transfer charger 20, cleaning with a brush 21 and discharging with a light source 22 can be repeatedly performed.

FIGS. 3 and 4 are non-limiting illustrative embodiments of the image forming apparatus of the present invention. For example, in FIG. 4, a pre-cleaning exposure may be performed between the transfer and cleaning processes.

As irradiation processes, an imagewise light exposure and a discharge exposure are illustrated. The photoreceptor can be irradiated with other known irradiation processes such as a pre-transfer exposure and an exposure before the imagewise light exposure.

Figure 5:
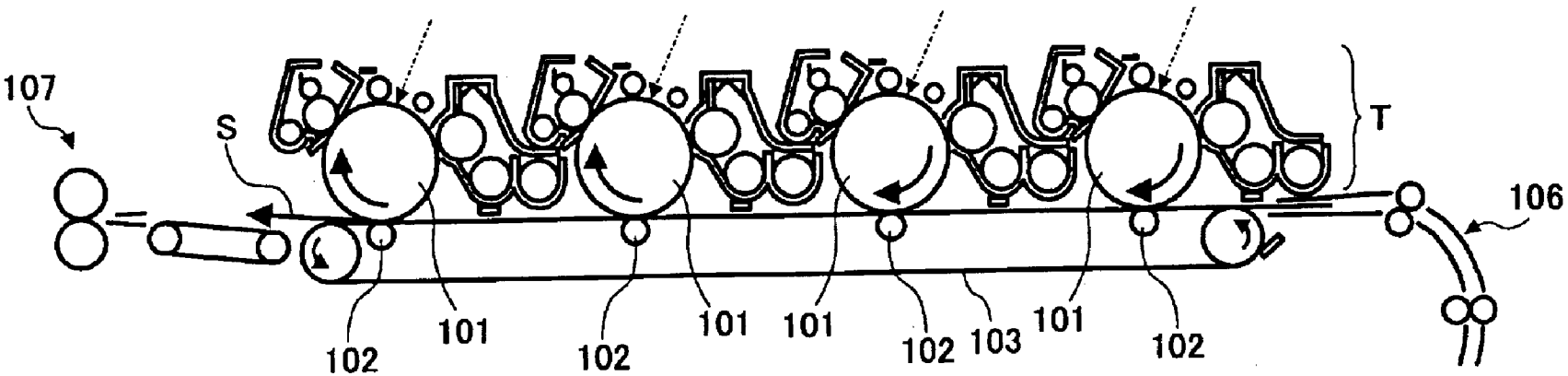
FIG. 5 is a schematic view illustrating an embodiment of a direct transfer tandem process according to the present invention.
Figure 6:
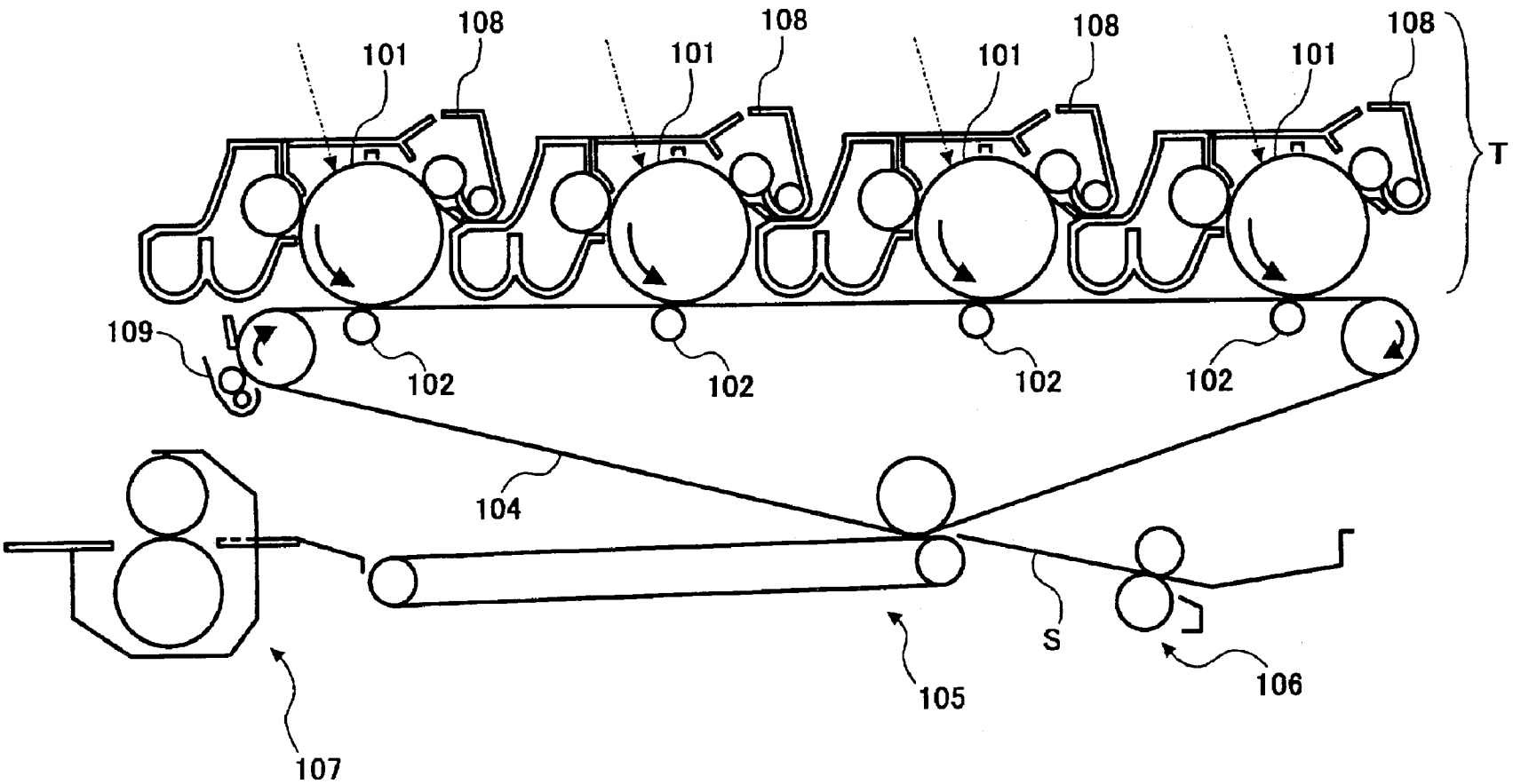
FIG. 6 is a schematic view illustrating an embodiment of an indirect transfer tandem process according to the present invention.

FIGS. 5 and 6 are schematic views illustrating tandem-type color image forming apparatuses.

A color electrophotographic apparatus can be a one-drum type apparatus in which plural color image developers located around a photoreceptor form a synthesized toner image thereon and the toner image is transferred onto a transfer sheet to form a color image thereon, and can be a tandem-type apparatus in which plural photoreceptors respectively have image developers and form a single-color toner image thereon, which are sequentially transferred onto a transfer sheet to form a synthesized color image thereon.

The one-drum apparatus has an advantage of small size and low cost because of having one photoreceptor, but has a disadvantage of low speed of forming a color image because the one photoreceptor repeats forming images (normally four times) to form a full-color image. The tandem apparatus has a disadvantage of a large size and high cost, but has an advantage of high-speed image formation.

The tandem-type apparatus can be used in high-speed image formation of a fill-color image which is equivalent to that of a monochrome image.

However, it is desirable that properties of each photoreceptor in the tandem-type apparatus remain constant because plural photoreceptors form a full-color image. The image forming apparatus of the present invention can be effectively used as they have high durability and sensitivity and produce high-quality images.

The tandem-type electrophotographic apparatus can include a direct transfer type as shown in FIG. 5, and can include an indirect transfer type as shown in FIG. 6. The direct transfer type sequentially transfers an image on each photoreceptor 101 with a transferer 102 onto a sheet s fed by a sheet feeding belt 103. The indirect transfer type sequentially transfers an image on each photoreceptor 101 with a first transferer 102 onto an intermediate transferer 104 and transfers the image thereon onto a sheet s with a second transferer 105. The transferer 105 can be a transfer feeding belt, and can be roller-shaped.

In comparing the direct transfer method with the indirect transfer method, the direct transfer type includes a paper feeder 106 in the upstream of a tandem-type image forming apparatus T and a fixer 107 in the downstream thereof, and has a disadvantage of being larger in the sheet feeding direction. To the contrary, the indirect transfer type can freely locate the second transferer, e.g., the paper feeder 106, the fixer 107*b* and the tandem-type image forming apparatus can be located overlying each other, and has an advantage of being reduced in size.

In order not to enlarge the direct transfer type in the sheet feeding direction, the fixer 107 can be closely located to the tandem-type image forming apparatus T. Therefore, the fixer 107 can be located such that there is insufficient space in which the sheet s can bend. Accordingly, due to an impact when a tip of the sheet s enters the fixer 107 (particularly when the sheet s is relatively thick), and due to a difference of sheet feeding speed between when passing through the fixer 107 and when fed by the transfer feeding belt, the fixer 107 of the direct transfer method has a drawback of affecting an image formation in the upstream. To the contrary, since the indirect transfer type can have a fixer 107 such that there is a sufficient space in which the sheet s can bend, the fixer 107 minimally affect the image formation.

Conventionally, the intermediate transfer belt is made of a resin such as fluorine containing resins, polycarbonate resins and polyamide resins. In recent years, a belt in which all or a part thereof is made of an elastic material has been used as the intermediate transfer belt.

When a color image is transferred using a resin belt, the following problems can occur.

A full color image is typically formed of four color toners. Therefore, one to four layer toner images are formed in a color image sheet. The toner layers are pressed at the primary transfer process (image transfer from the photoreceptor to the intermediate transfer medium) and secondary transfer process (image transfer from the intermediate transfer medium to the sheet), resulting in increase of cohesive force of the toner particles. When the cohesive force of the toner particles increases, undesired images, such as omissions in the center of character images, and omissions in the edge parts of solid images, tend to be produced. The resin belt is minimally deformed by the toner layers because of its high hardness, and therefore the toner layers are forcefully pressed, resulting in production of such image omissions in character images.

In recent years, there exists an increasing need to form images on various receiving materials such as Japanese paper and intentionally-roughened paper. However, when a toner image is transferred onto a rough paper, an air space tends to be formed between the toner image and the rough paper, resulting in formation of image omissions. If the pressure is increased at the secondary transfer position to improve the adhesion between the toner image and the rough paper, the cohesive force of the toner particles increase, resulting in formation of image omission in the center of character images.

The elastic belt can be used to avoid these disadvantages.

The elastic belt has a relatively low hardness, and therefore deforms at an image transfer position according to the toner layers and the surface of rough paper. The elastic belt deforms according to local asperities, and therefore an excessive transfer pressure is not applied to the toner layers. Thus, good adhesion is achieved and thereby images having good evenness can be formed even on a rough paper without producing such image omissions.

As the elastic rubbers and elastomers for use in the elastic belt, butyl rubbers, fluorine containing rubbers, acrylic rubbers, ethylene-propylene-diene-methylene (EPDM), acrylonitrile-butadiene rubbers (NBR), acrylonitrile-butadiene-styrene rubbers, natural rubbers, isoprene rubbers, styrene-butadiene rubbers, butadiene rubbers, ethylene-propylene rubbers, ethylene-propylene terpolymers, chloroprene rubbers, chlorosulfonated polyethylene, chlorinated polyethylene, urethane rubbers, syndiotactic, 1,2-polybutadiene, epichlorohydrin rubbers, silicone rubbers, polysulfide rubbers, polynorbornene rubbers, hydrogenated nitrile rubbers, thermoplastic elastomers (for example, polystyrene elastomers, polyolefin elastomers, polyvinyl chloride elastomers, polyurethane elastomers, polyamide elastomers, polyurea elastomers, polyester elastomers and fluorine containing elastomers), and the like materials can be used alone or in combination. However, the elastic rubber or elastomer of the elastic belt is not limited thereto.

Electroconductive materials which are used for controlling the resistance, are not particularly limited. Specific examples of such materials include carbon black, graphite, powders of a metal such as aluminum and nickel, electroconductive metal oxides such as tin oxide, titanium oxide, antimony oxide, indium oxide, potassium titanate, antimony oxide-tin oxide complex oxides (ATO), indium oxide-tin oxide complex oxides (ITO), etc. The electroconductive metal oxides may be coated by an insulating particles such as barium sulfate, magnesium silicate, and calcium carbonate. The electroconductive material in the elastic belt is not limited thereto.

The material for use in the surface layer of the elastic belt is not particularly limited. However, the material can decrease the adhesion of the surface of the transfer belt with toner images to improve the secondary transfer efficiency.

For example, materials, in which one or more lubricating powders and particles, which can reduce the surface energy and enhance the lubricating property, such as fluorine containing resins, fluorine containing compounds, carbon fluoride, titanium dioxide, and silicon carbide are dispersed in one or more of polyurethane, polyester, and epoxy resins, can be used. In addition, a fluorine containing rubber layer in which fluorine atoms are richly included in the surface thereof by heating the fluorine containing rubber can be used to reduce the surface energy thereof.

As a method of forming the belt, centrifugal molding methods in which a belt is formed by adding constituents in a rotating cylinder; spraying methods which are preferably used for forming the surface thin layer; dipping methods in which a cylinder is dipped in a coating liquid and then pulled up; injection methods in which constituents are injected into a space between inner and outer molds; and vulcanization/polish methods in which a compound wound around a mold is vulcanized and then polished, can be used and plural methods can be combined to form the belt. The methods are not limited thereto.

In order to avoid elongation of the belt, for example, the methods in which a rubber layer is formed on a core resin layer having low elongation percentage; and a material for decreasing elongation is added to a core layer can be used. However, these do not particularly influence on the manufacturing method.

Specific examples of the resins for use in the core resin layer having low elongation percentage include polycarbonate, fluorine containing resins (ETFE and PVDF); styrene resins (homopolymers and copolymers of styrene or a styrene derivatives such as polystyrene, polychrolostyrene, poly-α-methyl styrene, styrene-butadiene copolymers, styrene-vinyl chloride copolymers, styrene-vinyl acetate copolymers, styrene-maleic acid copolymers, styrene-acrylate copolymers (styrene-methyl acrylate copolymers, styrene-ethyl acrylate copolymers, styrene-butyl acrylate copolymers, styrene-octyl acrylate copolymers, styrene-phenyl acrylate copolymers, etc.), styrene-methacrylate copolymers (styrene-methyl methacrylate copolymers, styrene-ethyl methacrylate copolymers, styrene-phenyl methacrylate copolymers, etc.), styrene-methyl a-chloroacrylate, and styrene-acrylonitrile-acrylate copolymers); methyl methacrylate resins, butyl methacrylate resins, ethyl acrylate resins, butyl acrylate resins, modified acrylic resins (silicone modified acrylic resins, vinyl chloride resin modified, acrylic-urethane resins, etc.), vinyl chloride resins, vinyl chloride-vinyl acetate copolymers, rosin modified maleic resins, phenolic resins, epoxy resins, polyester resins, polyester-polyurethane resins, polyethylene, polypropylene, polybutadiene, polyvinylidene chloride, ionomer resins, polyurethane resins, silicone resins, ketone resins, ethylene-ethyl acrylate copolymers, xylene resins, polyvinyl butyral resins, polyamide resins, modified polyphenyleneoxide resins, and the like resins. These resins can be used alone or in combination. However, the resin for of the elastic belt is not limited thereto.

Specific examples of the materials for use in the core layer include natural fibers such as cotton and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenolic resin fibers; inorganic fibers such as carbon fibers, glass fibers and boron fibers; metal fibers such as iron fibers and copper fibers; and the like fibers. These fibers can be used alone or in combination. The materials to decrease elongation for use in the core layer of the belt is not limited thereto.

Threads may be a single filament and a thread in which plural filaments are twisted. The twisting methods are not particularly limited. Blended fabrics having plural kinds of fibers can also be used. In addition, the threads may be subjected to an electroconductive treatment.

As for woven cloth for weaving threads, any known cloths such as knitted cloth can be used. Of course, mixedly-woven cloths can be used. In addition, the fibers may be subjected to an electroconductive treatment.

The method for forming the core layer film including a fiber therein is not particularly limited. For example, the methods in which a cover film is formed on an endless fiber which is set on a mold; an endless fiber is dipped in a liquid rubber and the like to form a cover layer one by one or both sides of the fiber; and a cover film is formed on threads which are spirally wound around a mold at an interval, can be used.

The thickness of the elastic layer is determined depending on the hardness of the elastic layer. When the elastic layer is too thick, cracks can be formed on the surface layer because the surface largely elongates and shrinks. In addition, when the surface largely elongates and shrinks, the images thereon also elongate and shrink, and therefore it is not preferable that the thickness is too thick. Approximately, the thickness is preferably about 1 mm.

The hardness HS of the elastic layer is preferably from about 10° to about 65° (JIS-A). The suitable hardness can be determined depending on the thickness of the belt. When the hardness is lower than about 10° JIS-A, it can be difficult to prepare a belt having high dimensional accuracy because the belt shrinks or expands during molding. In order to soften the belt, a method in which an oil is added to the belt can be used. However, when such a belt is repeatedly used upon application of pressure thereto, the oil can bleed therefrom, resulting in contamination of the photoreceptor which contacts the surface of the intermediate transfer medium, such that uneven horizontal stripe images are formed. In general, a surface layer is formed to improve releasability. In order to prevent the oil bleeding, the surface layer can have a high requirements of durability. Therefore, it can be difficult to select a material suitable for the surface layer. To the contrary, when the hardness is higher than about 65° JIS-A, the belt can be formed with greater precision. In addition, it is possible that an oil is not added or a small amount of an oil is added therein. Therefore, the photoreceptor is minimally contaminated, but it is difficult to improve image transferability (i.e. to improve the image omission problem) and to tighten the belt with the rollers.

A process cartridge including at least one of a photoreceptor, an image forming device, a charger, an irradiator, an image developer and a transferer may detachably be installed in a copier in order to improve the maintenability.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were mixed and dispersed in a ball mill for 12 hrs to prepare an undercoat layer coating liquid:

| | |
|---|---|
| Alkyd resin (Bekkolite M6401-50 from Dainippon Ink & Chemicals, Inc.) | 15 |
| Melamine resin (Super Bekkamin G-821-60 from Dainippon Ink & Chemicals, Inc.) | 10 |
| Methyl ethyl ketone | 150 |
| Titanium oxide powder (Tipaque CR-E1 from Ishihara Sangyo Kaisha, Ltd.) | 90 |

The thus prepared undercoat layer coating liquid was coated on a cylindrical aluminium substrate having an outer diameter of 100 mm by a dip coating method, and the coated liquid was dried at 30° C. for 20 min to form an undercoat layer having a thickness of 3.5 μm on the substrate.

Figure 7:
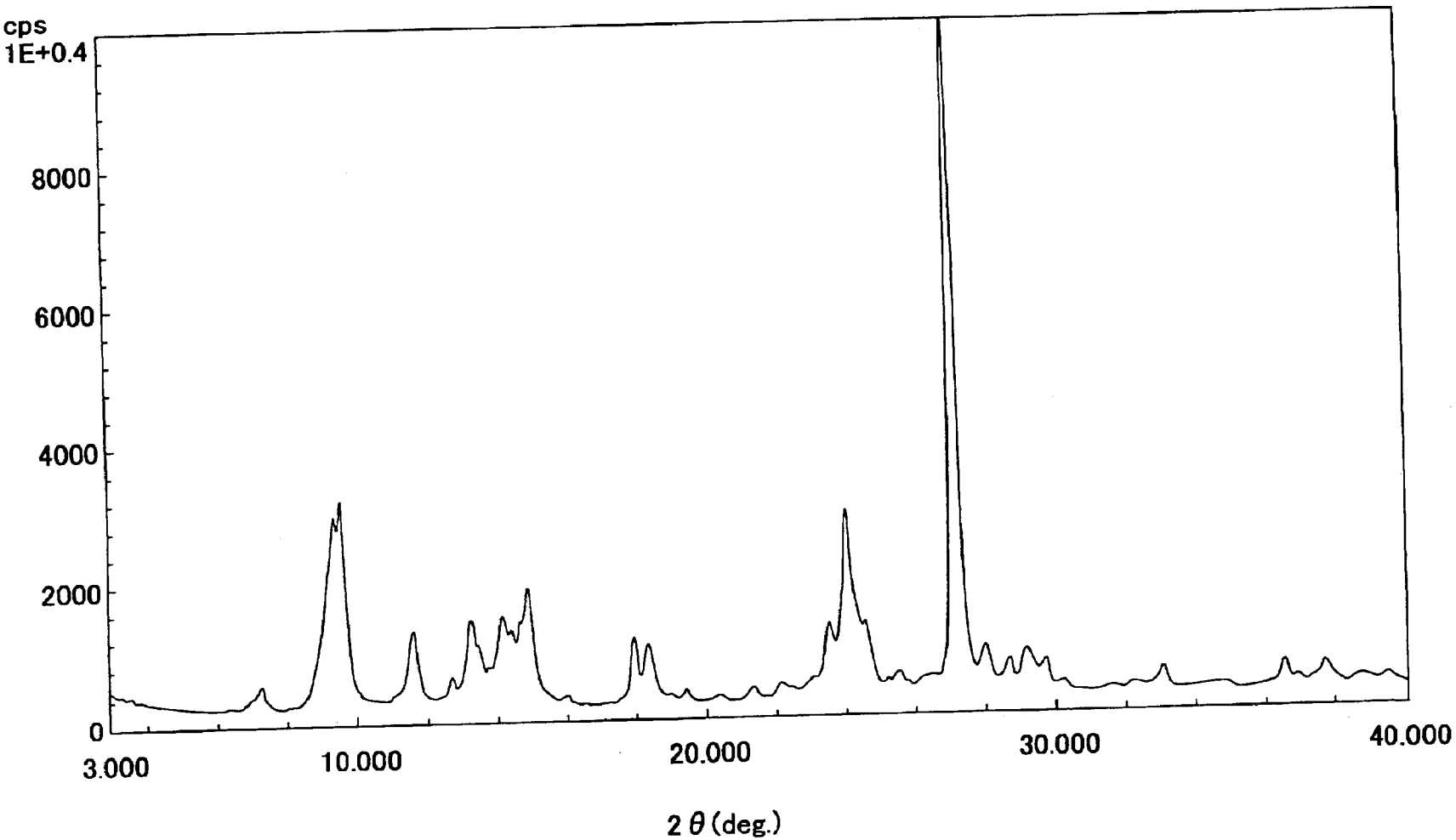
FIG. 7 is a XD spectrum of titanylphthalocyanine discussed in Example 1 according to the present invention.

| | |
|---|---|
| Polyvinylbutyral resin (S-lec HL-S from Sekisui Chemical Co., Ltd.) | 5 |
| 2-butanone | 150 |
| Titanylphthalocyanine having XD spectrum shown in FIG. 7 | 8 |

Further, 250 parts by weight of 2-butanone were included in the mixture and the mixture was dispersed for 3 hrs. The thus prepared CGL coating liquid was coated on the undercoat layer by a dip coating method, and the liquid was dried at 60° C. for 20 min to form a CGL having a thickness of 0.2 μm.

Next, the following materials were mixed to prepare a CTL coating liquid:

| | |
|---|---|
| Tetrahydrofuran | 100 |
| Bisphenol Z-type polycarbonate resin | 10 |
| Silicone oil (KF-50 from Shin-Etsu Chemical Co., Ltd.) | 0.002 |
| Charge transport material having the following formula (1) | 10 |

(1)

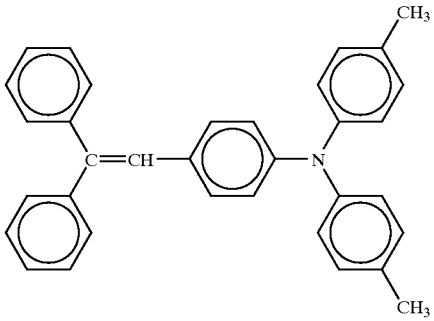

The thus prepared CTL coating liquid was coated on the CGL by a dip coating method, and the liquid was dried at 110° C. for 20 min to form a CGL having a thickness of 20 μm.

Next, the following materials were mixed and dispersed in a ball mil for 2 hrs to prepare a filler-reinforced CTL (hereinafter referred to as a filler-reinforced layer) coating liquid:

| | |
|---|---|
| Tetrahydrofuran | 80 |
| Cyclohexanone | 280 |
| Bisphenol Z-type polycarbonate resin | 4 |
| Charge transport material having the formula (1) | 3 |
| Alumina fine particles (average primary particle diameter of 0.3 μm) | 0.7 |

The thus prepared filler-reinforced layer coating liquid was coated on the CTL by a spray coating method, and the liquid was dried at 130° C. for 20 min to form a filler-reinforced layer having a thickness of 4 μm. Then, an electrophotographic photoreceptor in Example 1 was prepared.

The electrophotographic photoreceptor was installed in a digital copier Imagio MF6550 from Ricoh Company, Ltd. After a voltage of a charger was adjusted such that a potential of non-irradiated part (VD) of the photoreceptor was −700 V, images formed by writing equivalent to 600 dpi were produced and quality of the initial images were evaluated.

Further, after 500,000 images were produced, the image qualities were evaluated in the same method.

In addition, an abrasion amount of the photosensitive layer of the photoreceptor was measured by a thickness measurer Fisher scope MMS (from Fisher AG) using an eddy-current method.

Example 2

The procedures of preparation and evaluation for the photoreceptor in Example 1 were repeated except that the thicknesses of the CTL and filler-reinforced layer were changed to 10 μm and 3 μm respectively, and that the potential of non-irradiated part of the photoreceptor was changed to −700 V.

Example 3

The procedures of preparation and evaluation for the photoreceptor in Example 1 were repeated except that the thicknesses of the CTL and filler-reinforced layer were changed to 15 μm and 3 μm respectively, and that the potential of non-irradiated part of the photoreceptor was changed to −600 V.

Example 4

The procedures of preparation and evaluation for the photoreceptor in Example 1 were repeated except that the thicknesses of the CTL and filler-reinforced layer were changed to 5 μm and 13 μm respectively, and that the potential of non-irradiated part of the photoreceptor was changed to −600 V.

Example 5

The procedures of preparation and evaluation for the photoreceptor in Example 1 were repeated except that fine particles of titanium oxide were used as a filler instead of the fine particles of alumina.

Example 6

The procedures of preparation and evaluation for the photoreceptor in Example 1 were repeated except that fine particles of silica were used as a filler instead of the fine particles of alumina.

Comparative Example 1

The procedures of preparation and evaluation for the photoreceptor in Example 1 were repeated except that the parts by weight of the charge transport material included in the CTL coating liquid were changed from 10 to 7.

Comparative Example 2

The procedures of preparation and evaluation for the photoreceptor in Example 1 were repeated except that the parts by weight of the charge transport material included in the filler-reinforced CTL coating liquid were changed from 3 to 10.

Comparative Example 3

The procedures of preparation and evaluation for the photoreceptor in Example 1 were repeated except that the thicknesses of the CTL and filler-reinforced layer were changed to 25 μm and 5 μm respectively.

Comparative Example 4

The procedures of preparation and evaluation for the photoreceptor in Example 1 were repeated except that the potential of non-irradiated part of the photoreceptor was changed to −850 V.

Comparative Example 5

The procedures of preparation and evaluation for the photoreceptor in Example 2 were repeated except that the potential of non-irradiated part of the photoreceptor was changed to −200 V.

The results of the image evaluation and abrasion amount measurement are shown in Table 1.

TABLE 1

| | VD (−V) | Thickness of Photo-sensitive Layer (μm) | Initial Image | After 500,000 images were produced | Abrasion amount (μm) |
|---|---|---|---|---|---|
| Ex. 1 | 700 | 24 | Good | Good | 2.1 |
| Ex. 2 | 350 | 13 | Good | Good | 1.7 |
| Ex. 3 | 600 | 18 | Good | Good | 1.8 |
| Ex. 4 | 600 | 18 | Density of halftone image was slightly thin | Image density slightly deteriorated | 1.6 |
| Ex. 5 | 700 | 24 | Good | Good | 1.8 |
| Ex. 6 | 700 | 24 | Good | Good | 1.9 |
| Com. Ex. 1 | 700 | 24 | Density of halftone image was thin | Density of halftone image was thin | 1.9 |
| Com. Ex. 2 | 700 | 24 | Good | Background fouling occurred Image density deteriorated | 7.0 |
| Com. Ex. 3 | 700 | 30 | Gradation of halftone image was poor Fine dot reproducibility was slightly poor | Gradation of halftone image was poor Fine dot reproducibility was slightly poor | 2.1 |
| Com. | 850 | 24 | Image density | Image density | 2.9 |

TABLE 1-continued

| | VD (−V) | Thickness of Photo-sensitive Layer (μm) | Initial Image | After 500,000 images were produced | Abrasion amount (μm) |
|---|---|---|---|---|---|
| Ex. 4 | | | was thin | was thin Background fouling occurred | |
| Com. Ex. 5 | 200 | 13 | Gradation of halftone image was poor Background fouling occurred | Gradation of halftone image was poor Background fouling occurred Image density deteriorated | 1.8 |

Examples 7 and 8, and Comparative Example 6

The procedures of evaluations for the initial images in Examples 1 and 2, and Comparative Example 3 were respectively repeated except that the respective photoreceptors were installed in a modified digital copier Imagio MF6550 equipped with an optical system capable of writing equivalent to 1,200 dpi and 2, 400 dpi from Ricoh Company, Ltd. The results are shown in Table 2.

TABLE 2

| | 1,200 dpi image | 2,400 dpi image |
|---|---|---|
| Example 7 | Good | Dot reproducibility slightly deteriorated |
| Example 8 | Good | Good |
| Comparative Example 6 | Fine dot reproducibility was poor | Fine dot reproducibility was poor |

Examples 9 and 10, and Comparative Examples 7 and 8

The procedures of preparation for the photoreceptors and evaluations for the initial images in Examples 1 and 2, and Comparative Examples 1 and 2 were respectively repeated except for the use of g a cylindrical aluminium substrate having an outer diameter of 30 mm, and except that the respective photoreceptors were installed in a modified tandem-type color printer IPSio color 8000 using an intermediate transfer method (from Ricoh Company, Ltd.; a seamless intermediate transfer belt formed of a PVDF resin including a dispersed carbon was used as the intermediate transferer).

Further, after 100,000 images were produced, the image qualities were evaluated in the same method.

In addition, an abrasion amount of the photosensitive layer of the photoreceptor was measured by a thickness measurer Fisher scope MMS (from Fisher AG) using an eddy-current method.

Example 11

The procedures of evaluations for image qualities in Example 9 were repeated except that an elastic intermediate transfer belt prepared by the following method was used.

Elastic Intermediate Transfer Belt Production Example

A cylinder was dipped in a mixture of 100 parts of PCDF, 18 parts of carbon black, 3 parts of a disperser and 400 parts of toluene, and was slowly lifted therefrom at a rate of 10 mm/sec and dried at a room temperature to form a uniform coated film having a thickness of 75 μm on the cylinder. The cylinder on which the film having the thickness of 75 μm was dipped in the mixture again, and was slowly lifted therefrom at a rate of 10 mm/sec and dried at a room temperature to form a PVDF belt having a thickness 20 of 150 μm.

The PVDF cylinder having a thickness of 150 μm was dipped in a dispersion liquid in which 100 parts of a polyurethane polymer, 3 parts of a hardener (isocyanate), 20 parts of carbon black, 3 parts of a disperser and 500 parts of MEK were uniformly dispersed, and was lifted at a rate of 30 mm/sec and dried at a room temperature. After dried, the cylinder was dipped again in the liquid, lifted at a rate of 30 mm/sec and dried to form a desired urethane polymer layer having a thickness of 150 μm.

Further, the cylinder on which the urethane polymer layer having a thickness of 150 μm is formed was dipped in a dispersion liquid in which 100 parts of polyurethane polymer, 3 parts of a hardener (isocyanate), 50 parts of a PTFE fine powder, 4 parts of a disperser and 500 parts of MEK were uniformly dispersed, and was lifted at a rate of 30 mm/sec and dried at a room temperature. After dried, the cylinder was dipped again in the liquid, lifted at a rate 10 of 30 mm/sec and dried to form a urethane polymer surface layer including uniformly dispersed PTFE and having a thickness of 5 μm. Crosslinking reaction was performed on the thus prepared cylinder at 130° C. for 2 hrs to prepare a three-layered transfer belt including a resin layer, an elastic layer and a surface layer having a thickness of 150, 150 and 5 μm respectively.

The results are shown in Table 3

TABLE 3

| | VD (−V) | Initial Image | After 500,000 images were produced | Abrasion amount (μm) |
|---|---|---|---|---|
| Ex. 9 | 700 | Good | A few hollow images were produced | 2.5 |
| Ex. 10 | 350 | Good | A few hollow images were produced | 2.2 |
| Ex. 11 | 600 | Good | Good | 2.1 |
| Com. Ex. 7 | 700 | Density of halftone image was thin | Density of halftone image was thin | 2.3 |
| Com. Ex. 8 | 700 | Good | Background fouling occurred Image density deteriorated | 8.6 |

Having now fully described the invention, it will be apparent to one of ordinary skill in the art that many changes and modifications can be made thereto without departing from the spirit and scope of the invention as set forth therein.

What is claimed is:

1. An image forming apparatus comprising:

an electrophotographic photoreceptor comprising:

an electroconductive substrate;

a charge generation layer overlying the electroconductive substrate;

a first charge transport layer overlying the charge generation layer, the first charge transport layer comprising a first charge transport material and a first binder resin: and a second charge transport layer overlying the first charge transport layer, the second charge transport layer comprising a filler, a second charge transport material and a second binder resin, wherein the first and second charge transport layers have a total thickness of from about 5 to about 18 μm, wherein a weight ratio of the first charge transport material to the first binder resin is greater than a weight ratio of the second charge transport material to the second binder resin, and wherein a thickness of the first charge transport layer is greater than a thickness of the second charge transport layer;

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner adapted to form a toner image on the electrophotographic photoreceptor; and a transferer configured to transfer the toner image onto at least one of an intermediate transferer and a transfer sheet, wherein a non-irradiated part of the photoreceptor has a potential of from about −300 to about −600 V.

2. The image forming apparatus of claim 1, wherein the filler comprises an inorganic material including at least one of silica, alumina, and titanium oxide.

3. The image forming apparatus of claim 1, wherein the irradiator comprises at least one of a laser diode and a light emitting diode, and the electrostatic latent image has an image resolution not less than 1,200 dpi.

4. The image forming apparatus of claim 1, further comprising:

an intermediate transferer configured to receive the toner image developed on the electrophotographic photoreceptor and to transfer the toner image to the transfer sheet.

5. The image forming apparatus of claim 4, wherein the intermediate transferer comprises an elastic seamless belt including an elastic material.

6. A tandem full color image forming apparatus comprising:

a plurality of electrophotographic photoreceptors, each of the electrophotographic photoreceptors comprising:

an electroconductive substrate;

a charge generation layer overlying the electroconductive substrate;

a first charge transport layer overlying the charge generation layer, the first charge transport layer comprising a first charge transport material and a first binder resin: and a second charge transport layer overlying the first charge transport layer, the second charge transport layer comprising a filler, a second charge transport material and a second binder resin, wherein the first and second charge transport layers have a total thickness of from about 5 to about 18 μm, wherein a weight ratio of the first charge transport material to the first binder resin is greater than a weight ratio of the second charge transport material to the second binder resin, and wherein a thickness of the first charge transport layer is greater than a thickness of the second charge transport layer;

a plurality of chargers configured to charge the electrophotographic photoreceptors;

a plurality of irradiators configured to irradiate the electrophotographic photoreceptors to form electrostatic latent images thereon;

a plurality of image developers configured to develop the electrostatic latent images with developers each comprising a color toner adapted to form color toner images on the electrophotographic photoreceptors; and a plurality of transferers configured to transfer the color toner images onto at least one of an intermediate transferer and a transfer sheet, wherein a non-irradiated part of at least one of the photoreceptors has a potential of from about −300 to about −600 V.

7. The tandem full color image forming apparatus of claim 6, further comprising:

an intermediate transferer configured to receive each of the toner images developed on each of the electrophotographic photoreceptors so as to be overlaid thereon and to transfer the overlaid toner images to the transfer sheet.

8. The tandem full color image forming apparatus of claim 6, wherein the intermediate transferer comprises an elastic seamless belt including an elastic material.

9. A process cartridge comprising:

an electrophotographic photoreceptor comprising:

an electroconductive substrate;

a charge generation layer overlying the electroconductive substrate;

a first charge transport layer overlying the charge generation layer, the first charge transport layer comprising a first charge transport material and a first binder resin; and a second charge transport layer overlying the first charge transport layer, the second charge transport layer comprising a filler, a second charge transport material and a second binder resin, wherein the first and second charge transport layers have a total thickness of from about 5 to about 18 μm, wherein a weight ratio of the first charge transport material to the first binder resin is greater than a weight ratio of the second charge transport material to the second binder resin, and wherein a thickness of the first charge transport layer is greater than a thickness of the second charge transport layer; and at least one of (a) a charger configured to charge the electrophotographic photoreceptor;

(b) an irradiator configured to irradiate the electrophotographic photoreceptor to form an electrostatic latent image thereon;

(c) an image developer configured to develop the electrostatic latent image with a developer comprising a toner adapted to form a toner image on the electrophotographic photoreceptor; and (d) a transferer configured to transfer the toner image directly or indirectly onto a transfer sheet, wherein a non-irradiated part of the photoreceptor has a potential of from about −300 to about −600 V.

10. An image forming apparatus comprising:

an electrophotographic photoreceptor comprising:

an electroconductive substrate;

a charge generation layer overlying the electroconductive substrate;

a first charge transport layer overlying the charge generation layer, the first charge transport layer comprising a first charge transport means and a first binder means; and a second charge transport layer overlying the first charge transport layer, the second charge transport layer comprising a filler, a second charge transport means and a second binder means, wherein the first and second charge transport layers have a total thickness of from about 5 to about 18 $\mu$m, wherein a weight ratio of the first charge transport means to the first binder means is greater than a weight ratio of the second charge transport means to the second binder means, and wherein a thickness of the first charge transport layer is greater than a thickness of the second charge transport layer;

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner adapted to form a toner image on the electrophotographic photoreceptor; and a transferer configured to transfer the toner image onto at least one of an intermediate transferer and a transfer sheet, wherein a non-irradiated part of the photoreceptor has a potential of from about −300 to about −600 V.

* * * * *